US006834644B1

(12) United States Patent
Skinner et al.

(10) Patent No.: US 6,834,644 B1
(45) Date of Patent: Dec. 28, 2004

(54) CIRCULAR IGNITION COIL ASSEMBLY

(75) Inventors: Albert Anthony Skinner, Anderson, IN (US); John E Hazelwood, Anderson, IN (US); Thomas B. Bennett, Anderson, IN (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 10/770,874

(22) Filed: Feb. 3, 2004

(51) Int. Cl.[7] ..... F02P 1/00

(52) U.S. Cl. ..... 123/634; 336/90; 336/98; 336/219

(58) Field of Search ..... 123/634, 635; 336/90, 93, 94, 96, 98, 192, 198, 219, 212, 213, 234

(56) References Cited

U.S. PATENT DOCUMENTS 6,474,322 B1 * 11/2002 Ubukata et al. ..... 123/634
6,501,365 B1 12/2002 Elliott et al. ..... 336/234
6,650,219 B1 * 11/2003 Widiger et al. ..... 336/198
6,650,221 B2 * 11/2003 Oosuka et al. ..... 336/234
2002/0057185 A1 * 5/2002 Oosuka et al. ..... 336/234

OTHER PUBLICATIONS

"High density cylindrical laminated core," Publication No. 465011, Research Disclosure Jan. 2003.

* cited by examiner

*Primary Examiner*—John T. Kwon
(74) *Attorney, Agent, or Firm*—Jimmy L. Funke

(57) ABSTRACT

An ignition assembly provides a current to a spark plug to combust fuel in a cylinder of an internal combustion engine. The ignition coil assembly includes a primary winding defining a central axis. A secondary winding is wrapped about the primary winding coaxial with the central axis. The ignition coil assembly also includes a central core extending through the primary winding coaxial with the central axis. The central core includes a plurality of core components each having a single exterior surface that is continuous. In addition, each of the single exterior surface extends through an arcuate path.

14 Claims, 4 Drawing Sheets

CIRCULAR IGNITION COIL ASSEMBLY

BACKGROUND ART

1. Field of the Invention

The invention relates to an internal combustion engine spark ignition system. More specifically, the invention relates to an ignition coil designed to be mounted to a spark plug without damaging the ignition coil or the spark plug.

2. Description of the Related Art

The internal combustion engine can be categorized in several ways. One such way to categorize the internal combustion engine is whether the design requires a spark to combust the fuel within cylinders of the internal combustion engine. Diesel engines do not require a spark to be generated within the cylinders thereof. Non-diesel consuming internal combustion engines do, however, require a spark to ignite the fuel within the cylinders thereof.

With regard to non-diesel internal combustion engines the design thereof include the utilization of pencil ignition coils to operate the spark plugs. Recent developments in internal combustion engines include coils, sometimes called pencil coils, that are designed to be mounted directly to the spark plug. In addition, the pencil ignition coil is designed to primarily extend through the spark plug bore of the internal combustion engine. In other words, the pencil ignition coil is a long, thin pencil ignition coil designed to utilize the wasted space of the spark plug bore of the internal combustion engine.

U.S. Pat. No. 6,501,365, issued to Elliott et al. on Dec. 31, 2002 discloses an ignition coil having a generally circular core. The generally circular core is fabricated from a plurality of flat metal elements that are stacked together to create the core. The flat metal elements vary in widths such that the widths of the flat metal elements become smaller in size progressively as the flat metal elements are positioned away from the center of the core.

In addition, the lateral edges of the flat metal elements are angled such that they proximate a portion of a periphery of a circle. The resulting core includes two flat surfaces at either end where the last of the flat metal elements extend. While this design of a core increases the amount of metal within the core for increased performance of the ignition coil, the organization of the flat metal elements increases the time in manufacturing and keeping inventory on the cores for the ignition coils. Given the huge quantity of flat metal elements required to better proximate a circular core, a large amount of care must be taken to ensure each of the flat metal elements are aligned in their proper position with respect to the other flat metal elements. In addition, the flat metal elements can only be positioned in one of two positions and the orientation of the lateral sides is critical. It would be difficult to manufacture the core with a process that can accurately identify the orientation and position of each of the flat metal elements.

SUMMARY OF THE INVENTION

An ignition coil assembly provides a current to a spark plug to combust fuel in a cylinder of an internal combustion engine. The ignition coil assembly includes a primary winding defining a central axis. A secondary winding is wrapped about the primary winding coaxial with the central axis. The ignition coil assembly also includes a central core extending through the primary winding coaxial with the central axis. The central core includes a plurality of core components each having a single exterior surface that is continuous. In addition, the single exterior surface extends through an arcuate path.

BRIEF DESCRIPTION OF THE DRAWINGS

Advantages of the invention will be readily appreciated as the same becomes better understood by reference to the following detailed description when considered in connection with the accompanying drawings, wherein.

DETAILED DESCRIPTION OF THE PREFERRED EMBODIMENTS

Figure 1:
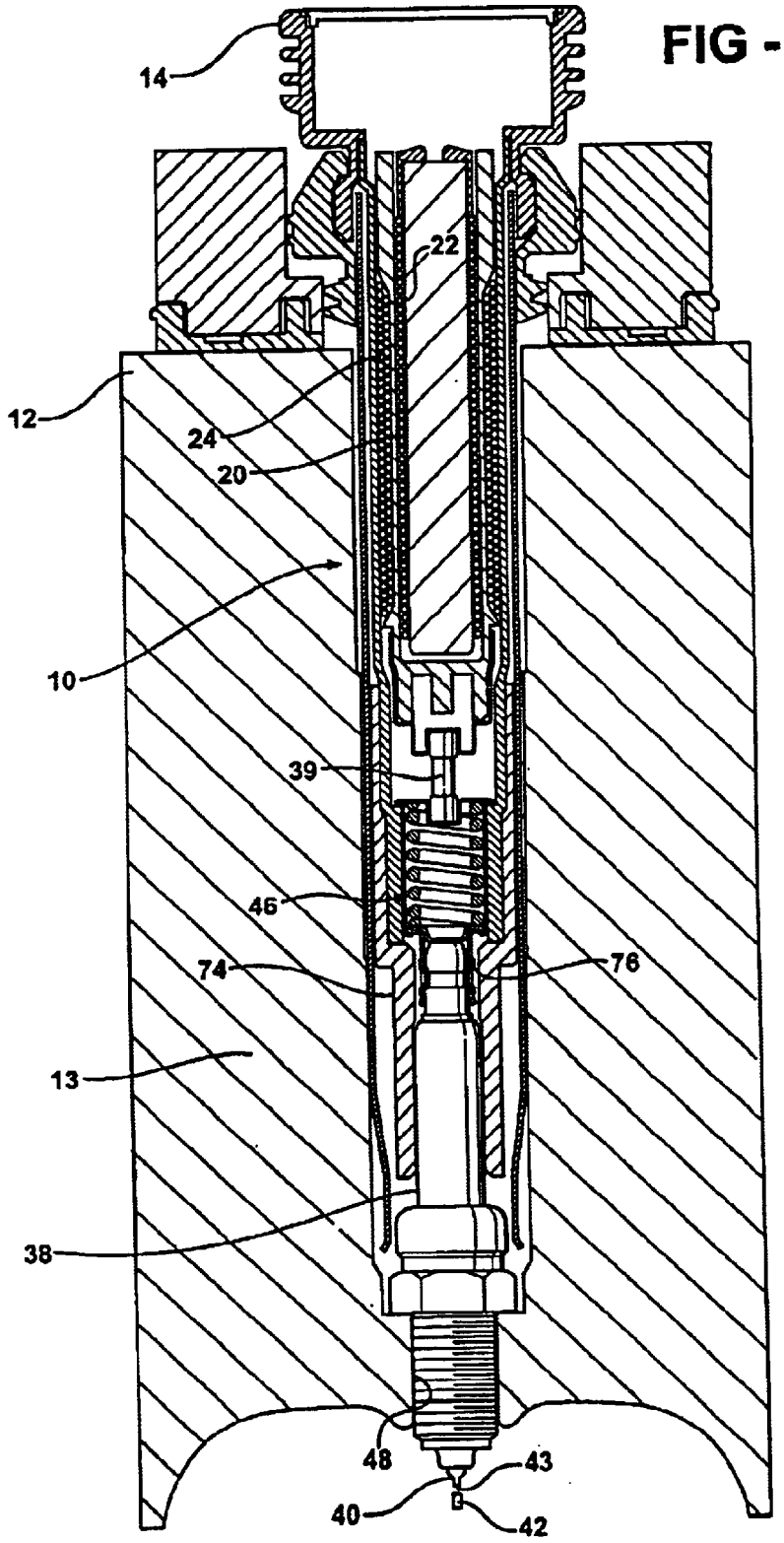
FIG. 1 is a cross-sectional side view of one embodiment of the invention mounted in a spark plug bore of an internal combustion engine.
Figure 2:
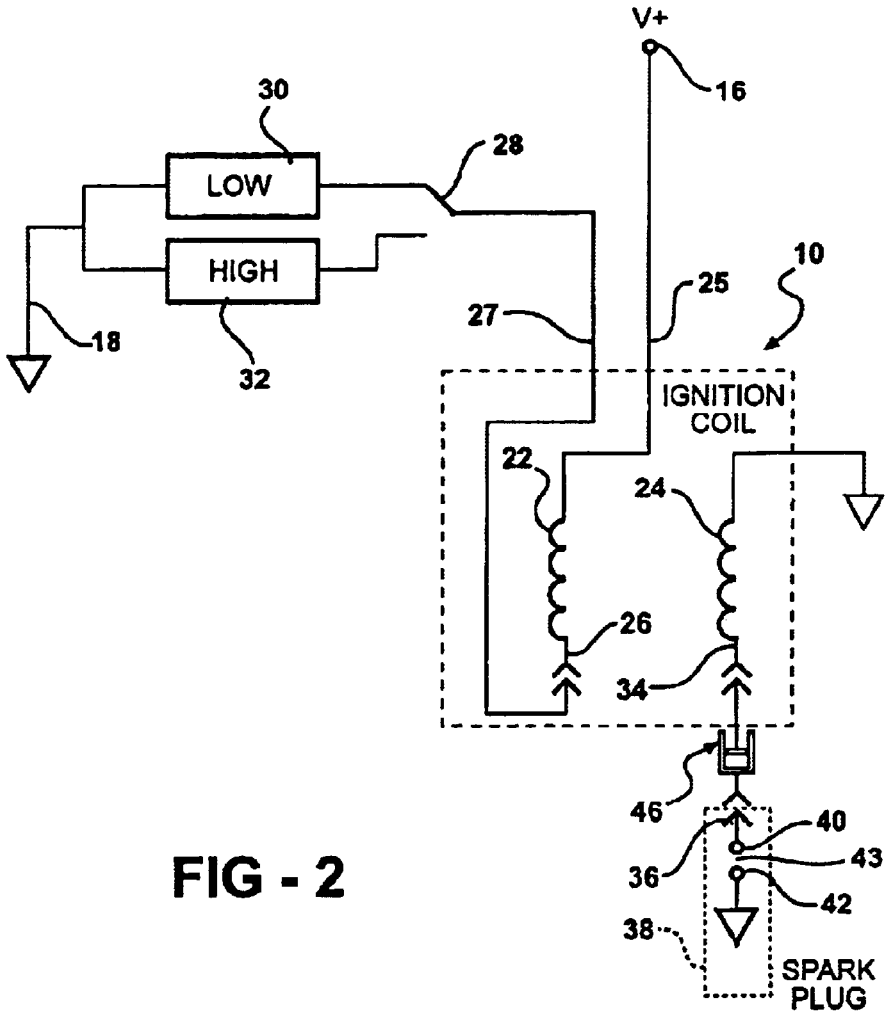
FIG. 2 is an electrical schematic of the pencil ignition coil and spark plug.

Referring to FIGS. 1 and 2, a side view of an ignition coil, generally indicated at 10, is shown mounted within an engine head 12 of an internal combustion engine 13. The ignition coil 10 includes a cover 14 that extends out of the engine head 12 and provides for electrical connection to a voltage source 16 as well as being operatively connected to ground 18, as is best seen in FIG. 2.

The ignition coil 10 also includes a ferromagnetic core 20 that is surrounded by a primary winding 22 and a secondary winding 24. The primary winding 22 is connected to the voltage source 16 through a first terminal 25. The second winding 24 is connected to ground on the low voltage side. The primary winding 22, central core 20 and secondary winding 24 are all co-axial and define a central axis 21. A subsequent end 26 of the primary winding 22 is connected through a second terminal 27 to a switch 28 that switches between a low impedance 30 and a high impedance 32. A subsequent end 34 of the secondary winding 24 is operatively connected to a terminal 36 of a spark plug 38 through a resistor 39. The spark plug 38 includes two terminals 40, 42 that define a gap 43. When the switch 28 switches from the low impedance 30 to the high impedance 32, a current is generated in the secondary winding 24 forcing current to pass between the two terminals 40, 42, creating a spark in the gap 43 therebetween. This spark ignites the fuel within a cylinder 44 of the internal combustion engine.

The ignition coil 10 also includes a shock absorbing device 46 that extends between the ferromagnetic core 20 and the spark 38. The shock absorbing device 46 may or may not be incorporated into ignition coil 10 as the ignition coil 10 operates with or without the shock absorbing device 46. The shock absorbing device 46 is the subject of a patent application of common ownership, the subject of which is hereby incorporated by reference.

Figure 3:
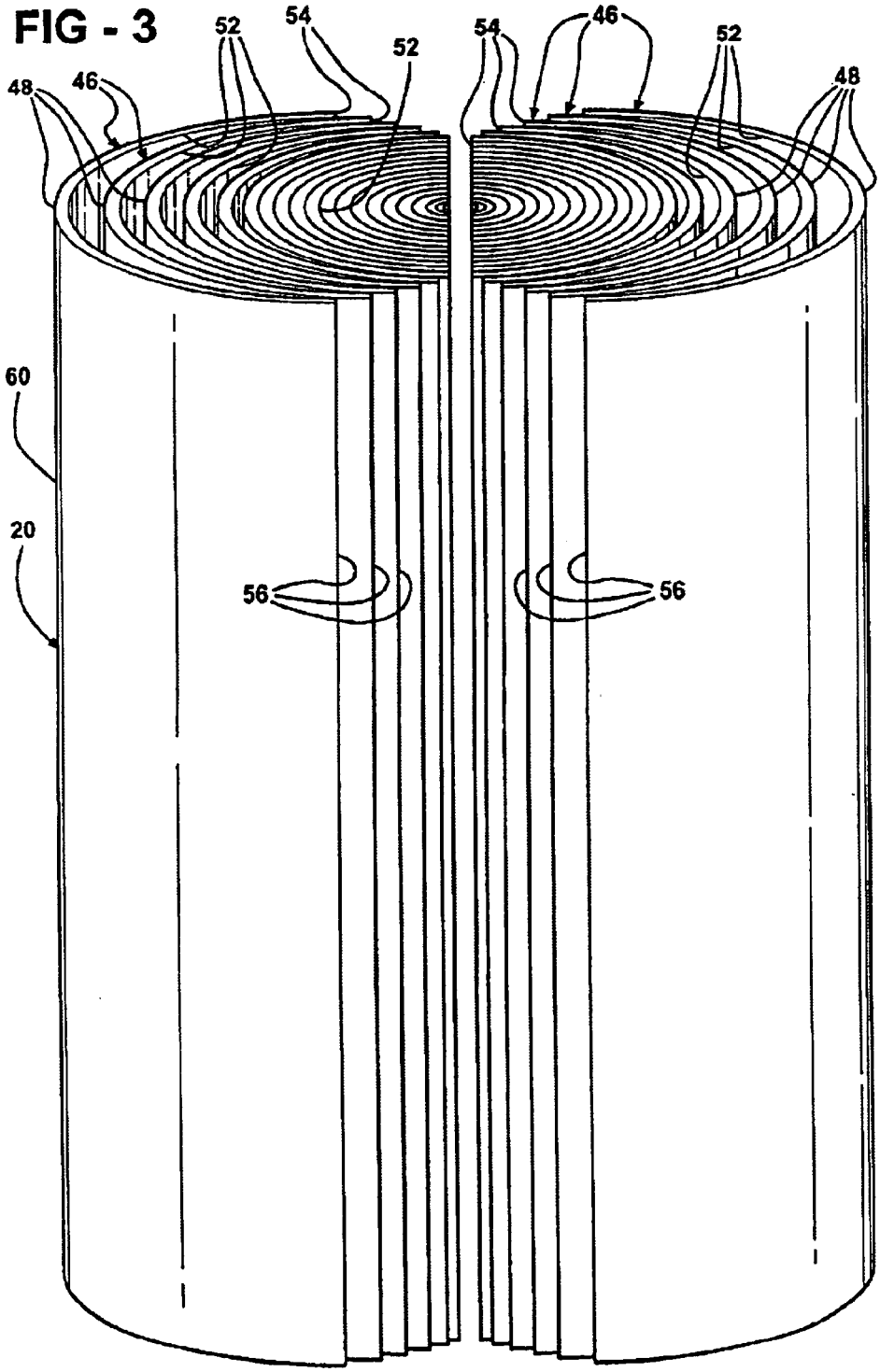
FIG. 3 is an exploded, end view of a first embodiment of the invention.

Referring to FIG. 3, the ferromagnetic or central core 20 is shown. The central core 20 includes a plurality of core components 46. The plurality of core components 46 each define a single exterior surface 48. The single exterior surface 48 is continuous and extends through an arcuate path. More specifically, the single exterior surface 48 is continuous and does not include any defined points that define a section of the exterior surface 48. There are no segments in the exterior surface 48 nor are there any portions of the exterior surface 48 that would be considered disjoint. Therefore, there is no delineation between portions of the exterior surface 48. While there may be occasions in which the arcuate path defined by the single exterior surface 48 is non-circular, a preferred embodiment of the ignition coil assembly 10 defines the arcuate path as circular.

The central core 20 also includes a case (not shown in FIG. 3) that holds the plurality of core components 46 concentrically about the central axis 21. The case is fabricated from a non-ferromagnetic material so that it will not interfere with the function of the central core 20 as it relates to the primary 22 and secondary 24 windings. The case may extend along either the entire length of the central core 20 or along a portion thereof.

In the first and second embodiments of the ignition coil assembly 10, 10', wherein like prime numerals represent elements of similar configuration, each of the plurality of core components 46 includes an interior surface 52 that is continuous and extends through an interior arcuate surface. As with the arcuate surface for the single exterior surface 48, the interior arcuate surface is also circular.

Figure 4:
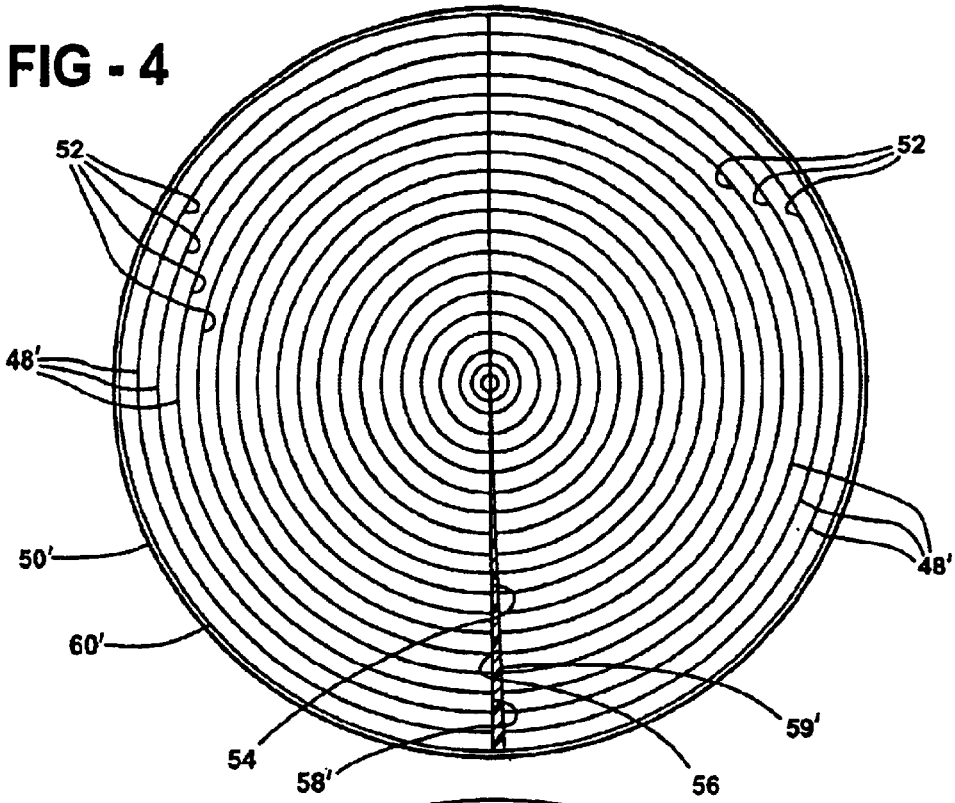
FIG. 4 is an end view of a second alternative embodiment of the invention.

Each of the core components 46 defines a first end 54 and a second end 56 that extend between the single exterior surface 48 and the interior surface 52. The first end 54 and the second end 56 are spaced apart to define a core gap 58 therebetween. In the embodiment shown, the plurality of core components 46 are designed to be assembled such that smaller core components 46 are surrounded by larger core components 46. This creates a solid cylindrical central core 20 with a continuous and near perfect cylindrical outer periphery 60 of the central core 20. In addition, the core components 46 stack in a manner that minimizes any space between the central core 20 and the primary winding 22 to that which is designed to be therebetween. More specifically, the near perfect outer periphery 60 of the central core 20 enhances the electromagnetic capabilities of the ignition coil assembly 10 by not having any incongruities there along. The case 50' is shown in FIG. 4.

The core gap 58 is designed such that transient cross-currents are not created within the central core 20. An insulating gap wedge 59' is inserted into the core gap 58. The core gap 58 is designed by having all of the first ends 56 of the plurality of core components 46 to be abutting each other. This allows for the second ends 56 to be spaced apart from each other. This is done by creating each of the plurality of core components 46 to extend through an arcuate path along a link that is slightly less than what it should be to form a complete circle with the other complimentary core components 46. Therefore, in the second embodiment (FIG. 4), the plurality of core components 46' extend through slightly less than a complete circle.

Figure 5:
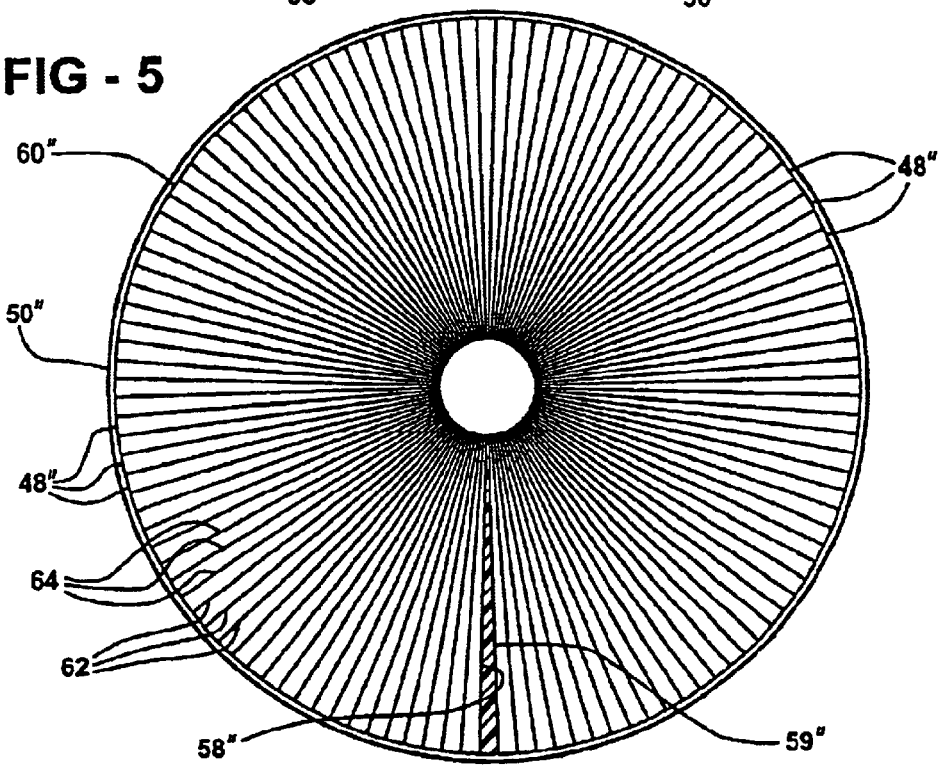
FIG. 5 is an end view of a third alternative embodiment of the invention.

In the third embodiment (FIG. 5), each of the plurality of core components 46 includes first 62 and second 64 intersecting surfaces. The first 62 and second 64 intersecting surfaces define an arc that is the single exterior surface 48 of the core component 46". The first 62 and second 64 intersecting surfaces intersect at a vertex 66 that defines a point of a pie shaped core component 46". In this embodiment, an insulating gap wedge 68 is used to prevent the transient cross-currents to extend through the plurality of core components 46" and aid in the positioning of the core components 46" with respect to each other. Therefore, the combination of the core components 46" and the insulating gap wedge 59" creates a solid cylinder defining the central core 20.

The invention has been described in an illustrative manner. It is to be understood that the terminology, which has been used, is intended to be in the nature of words of description rather than of limitation.

Many modifications and variations of the invention are possible in light of the above teachings. Therefore, within the scope of the appended claims, the invention may be practiced other than as specifically described.

What is claimed:

1. An ignition coil assembly for providing a current to a spark plug to combust fuel in a cylinder of an internal combustion engine, said ignition coil assembly comprising:

a primary winding defining a central axis;

a secondary winding wrapped about said primary winding coaxial with said central axis; and a central core extending through said primary winding coaxial with said central axis, said central core including a plurality of core components each having a single exterior surface that is continuous and extends through an arcuate path.

2. An ignition coil assembly as set forth in claim 1 wherein said arcuate path is circular.

3. An ignition coil assembly as set forth in claim 2 including a case for holding said plurality of core components concentrically about said central axis.

4. An ignition coil assembly as set forth in claim 3 wherein each of said plurality of core components includes an interior surface that is continuous and extends through an interior arcuate surface.

5. An ignition coil assembly as set forth in claim 4 wherein each of said plurality of core components defines a first end and a second end with each of said single exterior surfaces and said interior surfaces extending therebetween.

6. An ignition coil assembly as set forth in claim 5 wherein said first end and said second end are spaced apart to define a core gap therebetween.

7. An ignition coil assembly as set forth in claim 3 wherein each of said plurality of core components creates a circle.

8. An ignition coil assembly for providing a current to a spark plug to combust fuel in a cylinder of an internal combustion engine, said ignition coil assembly comprising:

a primary winding defining a central axis;

a secondary winding wrapped about said primary winding coaxial with said central axis;

a central core extending through said primary winding coaxial with said central axis, said central core including a plurality of core components each having a single exterior surface that is continuous and extends through an arcuate path; and an insulating gap wedge positioned concentrically with said plurality of core components.

9. An ignition coil assembly as set forth in claim 8 wherein said arcuate path is circular.

10. An ignition coil assembly as set forth in claim 9 including a case for holding said plurality of core components concentrically about said central axis.

11. An ignition coil assembly as set forth in claim 10 wherein each of said plurality of core components includes an interior surface that is continuous and extends through an interior arcuate surface.

12. An ignition coil assembly as set forth in claim 11 wherein each of said plurality of core components defines a first end and a second end with each of said single exterior surfaces and said interior surfaces extending therebetween.

13. An ignition coil assembly as set forth in claim 12 wherein said first end and said second end are spaced apart to define a core gap therebetween.

14. An ignition coil assembly for providing a current to a spark plug to combust fuel in a cylinder of an internal combustion engine, said ignition coil assembly comprising:

a primary winding defining a central axis;

a secondary winding wrapped about said primary winding coaxial with said central axis; and a central core extending through said primary winding coaxial with said central axis, said central core including a plurality of core components wherein each of said plurality of core components is a circle.

* * * * *